US005887631A

United States Patent [19]

Eaton

[11] Patent Number: 5,887,631

[45] Date of Patent: Mar. 30, 1999

[54] WIRE TWISTING AND CAPPING APPARATUS

[76] Inventor: Alan D. Eaton, 5439 Dogwood La., Gainesville, Ga. 30504

[21] Appl. No.: 60,983

[22] Filed: Apr. 12, 1998

Related U.S. Application Data

[60] Provisional application No. 60/045,666 May 6, 1997.

[51] Int. Cl.[6] ..... B21F 15/06

[52] U.S. Cl. ..... 140/118; 7/107; 81/125

[58] Field of Search ..... 7/107; 81/120, 81/120.1, 125; 140/117, 118, 120

[56] References Cited

U.S. PATENT DOCUMENTS

| | | | |
|---|---|---|---|
| 2,959,995 | 11/1960 | Linden | 7/107 |
| 3,244,208 | 4/1966 | McKenzie | 81/125 |
| 4,074,732 | 2/1978 | Wilkens | 140/120 |
| 4,512,219 | 4/1985 | Janssen . | |
| 4,823,650 | 4/1989 | Tuttle . | |
| 4,865,086 | 9/1989 | Robinson et al. . | |
| 5,379,809 | 1/1995 | Waulk . | |
| 5,560,402 | 10/1996 | Bates . | |

*Primary Examiner*—Lowell A. Larson

[57] ABSTRACT

A wire twisting and capping apparatus includes a main body portion which includes a longitudinal axis. A drive element is connected to a first end of the main body portion along the longitudinal axis. Conductor-reception channels are located at a second end of the main body portion. The conductor-reception channels are arranged parallel to the longitudinal axis. A translatable sleeve assembly is supported by the main body portion. The translatable sleeve assembly includes a locking assembly located at a first end of the translatable sleeve assembly. Also, the translatable sleeve assembly includes a main sleeve portion attached to the locking assembly, and the main sleeve portion includes insulator end cap receivers located at a second end of the translatable sleeve assembly for engaging an insulator end cap when the translatable sleeve assembly is translated away from the drive element. The wire twisting and capping apparatus is used for twisting bare ends of a plurality of conductors into an intertwined unitary conductor end structure and for installing an insulator end cap onto the intertwined unitary conductor end structure.

6 Claims, 3 Drawing Sheets

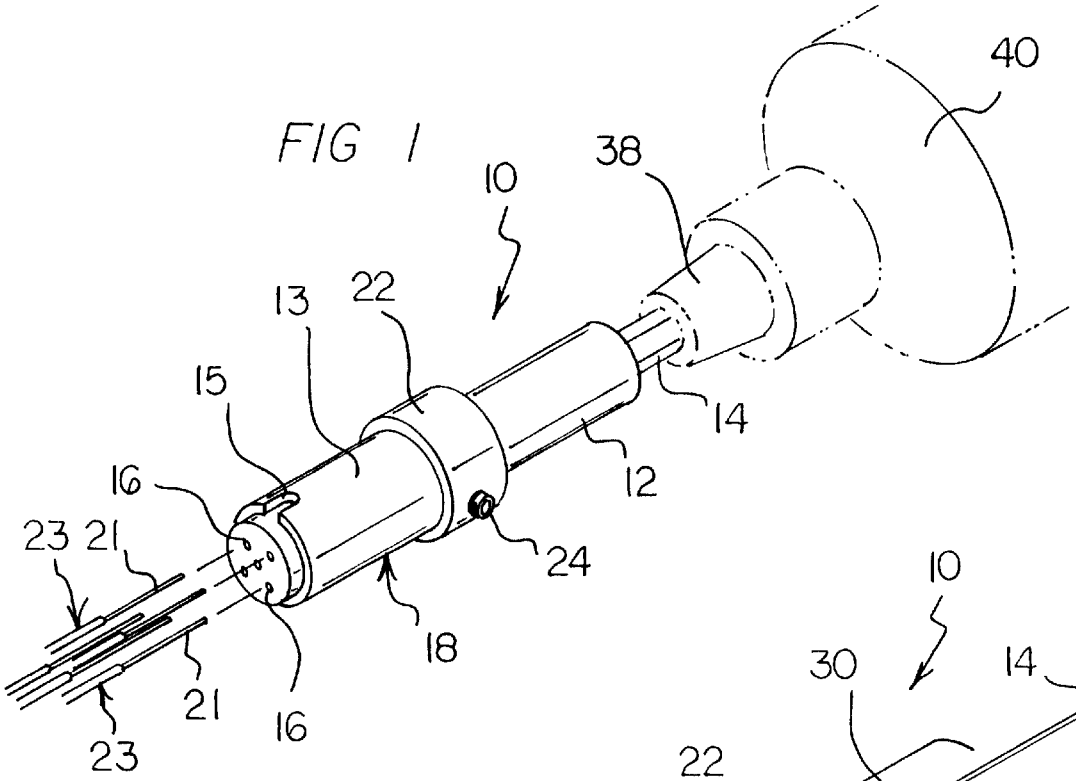
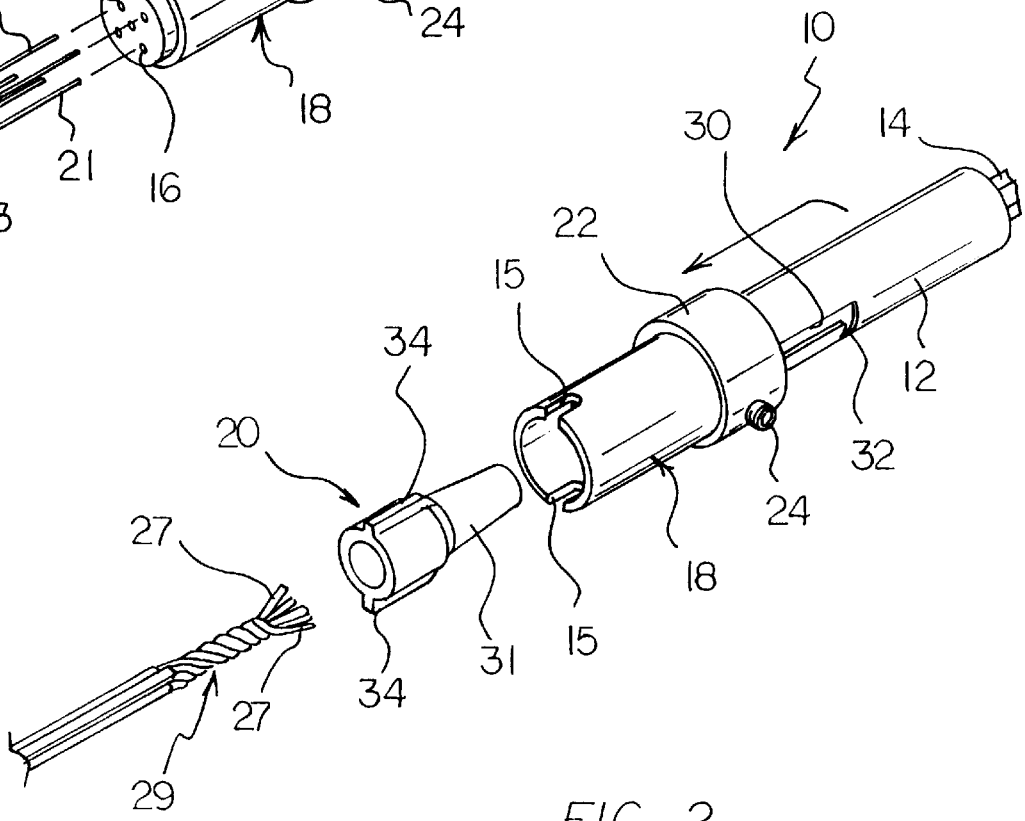
FIG 2

FIG 3
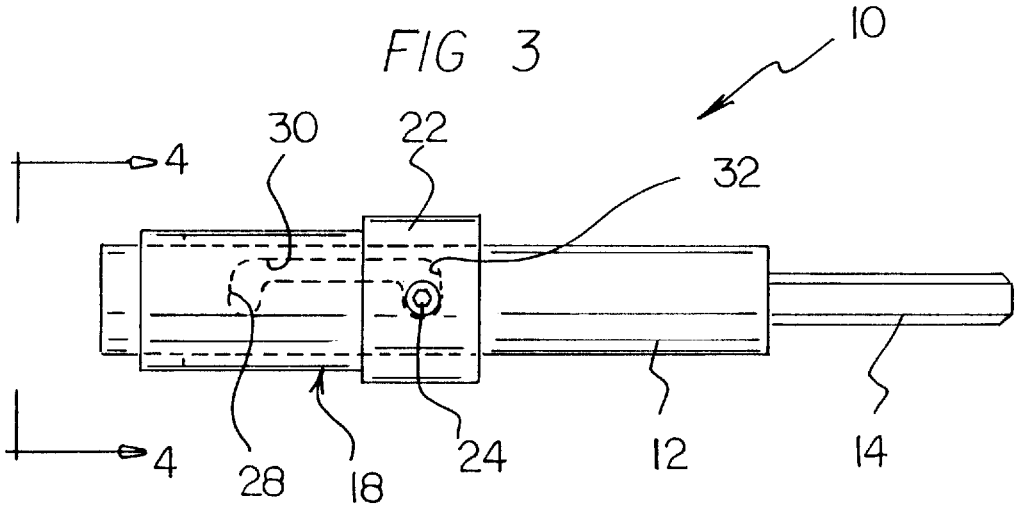
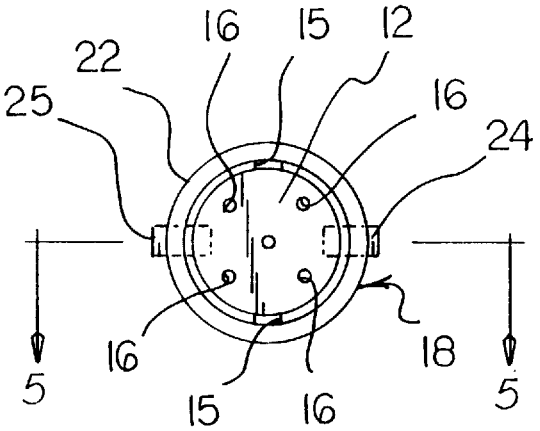
FIG 4

FIG 5
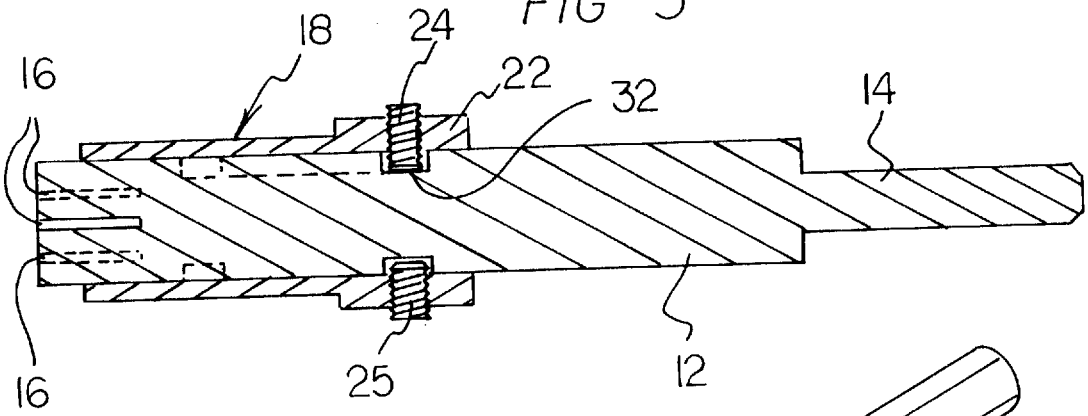
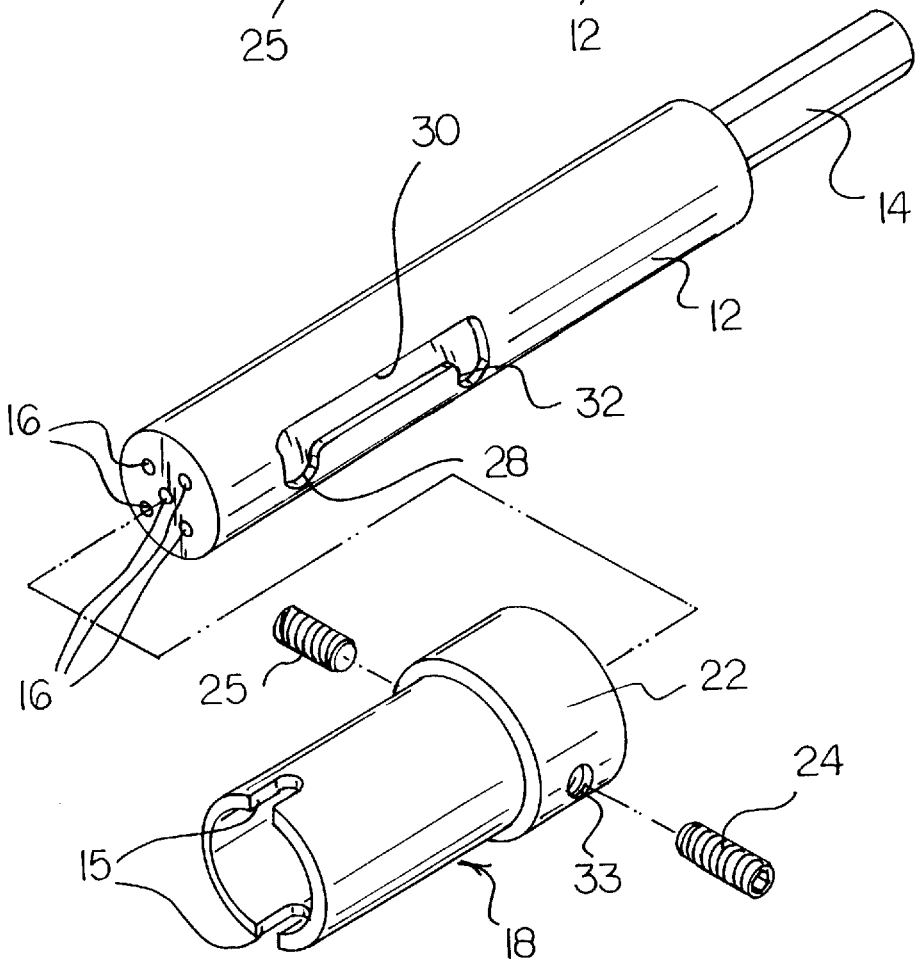
FIG 6

WIRE TWISTING AND CAPPING APPARATUS

BACKGROUND OF THE INVENTION

CROSS-REFERENCE TO RELATED APPLICATION

This application claims priority based upon my prior copending provisional application Ser. No. 60/045,666, filed May 6, 1997.

1. Field of the Invention

The present invention relates generally to devices for twisting ends of wire strands together and, more particularly, to a strand twisting device especially adapted for applying an insulator end cap to the twisted strands.

2. Description of the Prior Art

In the art of electrical wiring, it is often necessary insulate the bare ends of conductors. Conductors are often comprised of a plurality of wire strands, and an insulator end cap is installed on the bare ends of wire strands. To protect the wire strands from damage and to assure that the insulator end cap is securely attached to the bare wire ends, the wire ends are often twisted together before the insulator end cap is applied.

Throughout the years, a number of innovations have been developed relating to the treatment of the ends of wire conductors that have a plurality of wire strands. In addition, a number of innovations have been developed relating to the installation of an insulator end cap onto twisted wire ends, and the following U.S. Pat. Nos. are representative of some of those innovations: 4,512,219, 4,823,650, 4,865,086, 5,379,809, and 5,560,402. More specifically, U.S. Pat. No. 4,512,219 discloses a tool for installing a wire harness at the ends of a plurality of bare wire ends to bind the bare wire ends together. However, this device does not provide for the installation of an insulator end cap to the bound together wire ends. In this respect, it would be desirable if a device were provided by which an insulator end cap is installed to the twisted ends of bare wires.

U.S. Pat. No. 4,823,650 discloses a power driven wire nut wrench that installs an insulator end cap on bare wire ends. It is noted that, with this device, wire strands are not arranged so that the wire strands are twisted in a desired manner. In this respect, it would be desirable if a device were provided by which a plurality of bare wire ends are twisted in a desired manner.

Each of U.S. Pat. No. 4,865,086 and U.S. Pat. No. 5,379,809 discloses a device for twisting wire conductors together. With each device, however, the wire conductors are not individually aligned prior to their being twisted together. To provide for optimum twisting, however, it would be desirable if a device were provided that individually aligns wire strands prior to their being twisted together.

U.S. Pat. No. 5,560,402 may be of interest for its disclosure of a reversible direction wire twisting pliers.

Still other features would be desirable in a wire twisting and capping apparatus. For example, it would be desirable if a device were provided that is easily converted from a wire twisting device to an insulator end cap installing device. Also, it would be desirable if a wire twisting and capping apparatus were easily connectable to a power drill.

Thus, while the foregoing body of prior art indicates it to be well known to use devices for twisting bare ends of wires, the prior art described above does not teach or suggest a wire twisting and capping apparatus which has the following combination of desirable features: (1) provides for the installation of an insulator end cap to the twisted ends of bare wires; (2) permits a plurality of bare wire ends to be twisted in a desired manner; (3) individually aligns wire strands prior to their being twisted together; (4) is easily converted from a wire twisting device to an insulator end cap installing device; and (5) is easily connectable to a power drill. The foregoing desired characteristics are provided by the unique wire twisting and capping apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a wire twisting and capping apparatus which includes a main body portion which includes a longitudinal axis. A drive element is connected to a first end of the main body portion along the longitudinal axis. Conductor-reception channels are located at a second end of the main body portion. The conductor-reception channels are arranged parallel to the longitudinal axis. A translatable sleeve assembly is supported by the main body portion. The translatable sleeve assembly includes a locking assembly located at a first end of the translatable sleeve assembly. Also, the translatable sleeve assembly includes a main sleeve portion attached to the locking assembly, and the main sleeve portion includes insulator end cap receivers located at a second end of the translatable sleeve assembly for engaging an insulator end cap when the translatable sleeve assembly is translated away from the drive element. The wire twisting and capping apparatus is used for twisting bare ends of a plurality of conductors into an intertwined unitary conductor end structure and for installing an insulator end cap onto the intertwined unitary conductor end structure.

The insulator end cap receivers includes notches for receiving handle flanges located on an insulator end cap. The drive element is in a form of a polygonally-shaped shaft that fits into a chuck of an electric drill. The locking assembly includes a locking screw retainer, and a first locking screw retained by the locking screw retainer. The locking assembly further includes a second locking screw retained by the locking screw retainer in a position opposite to the first locking screw.

The main body portion includes a sleeve guide channel which includes a front transverse guide portion. A longitudinal guide portion is in communication with the front transverse guide portion, and a rear transverse guide portion is in communication with the longitudinal guide portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wire twisting and capping apparatus which has all of the advantages of the prior art and none of the disadvantages.

It is another object of the present invention to provide a new and improved wire twisting and capping apparatus which may be easily and efficiently manufactured and marketed.

It is a further object of the present invention to provide a new and improved wire twisting and capping apparatus which is of durable and reliable construction.

An even further object of the present invention is to provide a new and improved wire twisting and capping apparatus which is susceptible of a low cost of manufacture with regard to both materials and labor, and which accordingly is then susceptible of low prices of sale to the consuming public, thereby making such wire twisting and capping apparatus available to the buying public.

Still yet a further object of the present invention is to provide a new and improved wire twisting and capping apparatus which provides for the installation of an insulator end cap to the twisted ends of bare wires.

Still another object of the present invention is to provide a new and improved wire twisting and capping apparatus by which a plurality of bare wire ends are twisted in a desired manner.

Yet another object of the present invention is to provide a new and improved wire twisting and capping apparatus which individually aligns wire strands prior to their being twisted together.

Even another object of the present invention is to provide a new and improved wire twisting and capping apparatus that is easily converted from a wire twisting device to an insulator end cap installing device.

Still a further object of the present invention is to provide a new and improved wire twisting and capping apparatus which is easily connectable to a power drill.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the wire twisting and capping apparatus of the invention attached to an electric drill and about to be used for twisting ends of a plurality of individual, exposed wire conductors into an intertwined unitary structure.

FIG. 2 is a perspective view of the embodiment of the wire twisting and capping apparatus shown in FIG. 1 about to be used to twist an insulator end cap onto the intertwined unitary conductor end structure.

FIG. 3 is an enlarged side view of the embodiment of the wire twisting and capping apparatus of FIG. 1.

FIG. 4 is an enlarged frontal view of the embodiment of the invention shown in FIG. 3 taken along line 4—4 thereof.

FIG. 5 is a cross-sectional view of the embodiment of the invention shown in FIG. 4 taken along line 5—5 thereof.

FIG. 6 is an exploded perspective view of the embodiment of the invention shown in FIG. 5.

DESCRIPTION OF THE PREFERRED EMBODIMENT

With reference to the drawings, a new and improved wire twisting and capping apparatus embodying the principles and concepts of the present invention will be described.

Turning to FIGS. 1–6, there is shown an exemplary embodiment of the wire twisting and capping apparatus of the invention generally designated by reference numeral 10. In its preferred form, wire twisting and capping apparatus 10 includes a main body portion 12 which includes a longitudinal axis 13. A drive element is connected to a first end of the main body portion 12 along the longitudinal axis 13. Conductor-reception channels 16 are located at a second end of the main body portion 12. The conductor-reception channels 16 are arranged parallel to the longitudinal axis 13. A translatable sleeve assembly 18 is supported by the main body portion 12. The translatable sleeve assembly 18 includes a locking assembly located at a first end of the translatable sleeve assembly 18. Also, the translatable sleeve assembly 18 includes a main sleeve portion 19 attached to the locking assembly, and the main sleeve portion 19 includes insulator end cap receivers located at a second end of the translatable sleeve assembly 18 for engaging an insulator end cap 20 when the translatable sleeve assembly 18 is translated away from the drive element. The wire twisting and capping apparatus 10 is used for twisting bare ends of a plurality of conductors into an intertwined unitary conductor end structure 29 and for installing an insulator end cap 20 onto the intertwined unitary conductor end structure 29.

The insulator end cap receivers includes notches 15 for receiving handle flanges 34 located on an insulator end cap 20. The drive element is in a form of a polygonally-shaped shaft 14 that fits into a chuck 38 of an electric drill 40. The locking assembly includes a locking screw retainer 22, and a first locking screw 24 retained by the locking screw retainer 22. A threaded aperture 33 is present in the locking screw retainer 22 to receive the first locking screw 24. The locking assembly further includes a second locking screw 25 retained by the locking screw retainer 22 in a position opposite to the first locking screw 24. Another threaded aperture is present in the locking screw retainer 22 to receive the second locking screw 25.

The main body portion 12 includes a sleeve guide channel which includes a front transverse guide portion 28. A longitudinal guide portion 30 is in communication with the front transverse guide portion 28, and a rear transverse guide portion 32 is in communication with the longitudinal guide portion 30.

To use the wire twisting and capping apparatus 10 of the invention, reference is first made to FIG. 1. The shaft 14 has been inserted into the chuck 38 of an electric drill 40 and secured thereto. The translatable sleeve assembly 18 is positioned along the main body portion 12 in a retracted orientation such that the translatable sleeve assembly 18 is relatively close to the shaft 14. In this position, the first locking screw 24 resides in the rear transverse guide portion 32 of the sleeve guide channel, and the first locking screw 24 and the second locking screw 25 are tightened against the main body portion 12. Also, in this position, the front end of the translatable sleeve assembly 18 is positioned behind the front end of the main body portion 12, whereby the conductor-reception channels 16 are exposed and accessible.

Bare ends 21 of a plurality of conductors 23 are inserted into the conductor-reception channels 16. Then, the electric drill 40 is turned on briefly. As a result, the bare ends 21 are twisted into an intertwined unitary conductor end structure 29 such as shown in FIG. 2. Once the intertwined unitary conductor end structure 29 is formed, the free ends 27 can be trimmed off prior to installation of an insulator end cap 20.

To install the insulator end cap 20, reference is made to FIG. 2. The translatable sleeve assembly 18 is first translated away from the shaft 14. To do so, the first locking screw 24 and the second locking screw 25 are loosened. Then, the translatable sleeve assembly 18 is rotated around the translatable sleeve assembly 18 so that the first locking screw 24 resides at the end of the longitudinal guide portion 30. Then, the translatable sleeve assembly 18 is translated longitudinally away from the shaft 14 along the longitudinal axis 13 so that the main sleeve portion 19 and the notches 15 extend away from the front end of the main body portion 12, as shown in FIG. 2. The translatable sleeve assembly 18 is rotated again so that the first locking screw 24 resides in the front transverse guide portion 28 of the sleeve guide channel. Then, the first locking screw 24 is retightened, whereby the translatable sleeve assembly 18 is locked into the position shown in FIG. 2 for installing an insulator end cap 20 on the intertwined unitary conductor end structure 29.

The main sleeve portion 19 has a sufficient longitudinal length so that the top portion 31 of the insulator end cap 20 is received in the main sleeve portion 19 when ends of the handle flanges 34 of the insulator end cap 20 engage the notches 15 in the main sleeve portion 19. Once the insulator end cap 20 is inserted into the main sleeve portion 19 so that the handle flanges 34 engage the notches 15, the intertwined unitary conductor end structure 29 is inserted into the insulator end cap 20. Then, the electric drill 40 is turned on briefly, and the insulator end cap 20 is screwed onto the intertwined unitary conductor end structure 29. Once this is done, the translatable sleeve assembly 18 is pulled longitudinally away from the insulator end cap 20 which has been screwed onto the intertwined unitary conductor end structure 29.

To twist another plurality of conductors 23, the first locking screw 24 and the second locking screw 25 are loosened, and the translatable sleeve assembly 18 is rotated so that the first locking screw 24 resides in the longitudinal guide portion 30. Then, the translatable sleeve assembly 18 is translated longitudinally towards the shaft 14 until the first locking screw 24 reaches the end of the longitudinal guide portion 30. Then, the translatable sleeve assembly 18 is rotated so that the first locking screw 24 resides in the rear transverse guide portion 32. Then, the first locking screw 24 and the second locking screw 25 are tightened, and the first locking screw 24 is locked in the rear transverse guide portion 32.

Although the wire twisting and capping apparatus 10 of the invention has been illustrated as has a shaft 14 which fits into the chuck 38 of an electric drill 40, it is also contemplated that the wire twisting and capping apparatus 10 of the invention can be used manually both to twist the bares ends of a plurality of conductors into an intertwined unitary conductor end structure 29 and to screw an insulator end cap 20 onto the intertwined unitary conductor end structure 29.

The components of the wire twisting and capping apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved wire twisting and capping apparatus that is low in cost, relatively simple in design and operation, and which may advantageously be used for the installation of an insulator end cap to the twisted ends of bare wires. With the invention, a wire twisting and capping apparatus is provided by which a plurality of bare wire ends are twisted in a desired manner. With the invention, a wire twisting and capping apparatus is provided which individually aligns wire strands prior to their being twisted together. With the invention, a wire twisting and capping apparatus is provided which is easily converted from a wire twisting device to an insulator end cap installing device. With the invention, a wire twisting and capping apparatus is provided which is easily connectable to a power drill.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A wire twisting and capping apparatus, comprising:

a main body portion which includes a longitudinal axis, a drive element connected to a first end of said main body portion along said longitudinal axis, conductor-reception channels located at a second end of said main body portion, wherein said conductor-reception channels are arranged parallel to said longitudinal axis, and a translatable sleeve assembly supported by said main body portion, wherein said translatable sleeve assembly includes a locking assembly located at a first end of said translatable sleeve assembly, wherein said translatable sleeve assembly includes a main sleeve portion attached to said locking assembly, and wherein said main sleeve portion includes insulator end cap receivers located at a second end of said translatable sleeve assembly for engaging an insulator end cap when said translatable sleeve assembly is translated away from said drive element.

2. The apparatus of claim 1 wherein said insulator end cap receivers include notches for receiving handle flanges located on an insulator end cap.

3. The apparatus of claim 1 wherein said drive element is in a form of a polygonally-shaped shaft that fits into a chuck of an electric drill.

4. The apparatus of claim 1 wherein said locking assembly includes:

a locking screw retainer, and a first locking screw retained by said locking screw retainer.

5. The apparatus of claim 4 wherein said locking assembly further includes:

a second locking screw retained by said locking screw retainer in a position opposite to said first locking screw.

6. The apparatus of claim 1 wherein said main body portion includes a sleeve guide channel which includes:

a front transverse guide portion, a longitudinal guide portion in communication with said front transverse guide portion, and a rear transverse guide portion in communication with said longitudinal guide portion.

* * * * *